US005272801A

United States Patent [19]

Wallace

[11] Patent Number: 5,272,801

[45] Date of Patent: Dec. 28, 1993

[54] FIBER CORE CAP REMOVER

[76] Inventor: Marcus T. Wallace, 530 Carter La., Smyrna, Tenn. 37167

[21] Appl. No.: 952,917

[22] Filed: Sep. 28, 1992

[51] Int. Cl.[5] ..... B23P 19/04

[52] U.S. Cl. ..... 29/564.3; 29/267; 29/283.5

[58] Field of Search ..... 29/566.1, 564.3, 253, 29/267, 283.5, 234, 280

[56] References Cited

U.S. PATENT DOCUMENTS

| | | | |
|---|---|---|---|
| 2,130,496 | 9/1938 | Hopkins | 29/253 |
| 2,191,021 | 2/1940 | Ladd | 29/261 |
| 2,548,697 | 4/1951 | Belpedio et al. | 29/267 X |
| 3,512,240 | 5/1970 | Robinson | 29/566.1 |
| 3,763,619 | 10/1973 | Stone | 242/68.5 |
| 3,942,638 | 3/1976 | Stone | 206/416 |
| 4,195,399 | 4/1980 | Rasmussen | 29/429 |
| 4,233,730 | 11/1980 | Godbe | 29/283.5 |
| 4,460,087 | 7/1984 | DeMarco | 206/415 |
| 4,557,029 | 12/1985 | Stewart | 29/253 |
| 4,995,512 | 2/1991 | Liebel | 206/396 |

*Primary Examiner*—William Briggs
*Attorney, Agent, or Firm*—Edward D. Lanquist, Jr.; Mark J. Patterson; I. C. Waddey, Jr.

[57] ABSTRACT

The present invention discloses a device for removing a cap from a fiber core. The device has a housing which resides on a base. The housing includes a receiving member which is defined by a front opening, a rear opening distally located from the front opening, an top wall and an bottom wall joining the front opening and rear openings, a right wall and a left wall joining said front opening to said rear opening and joining said top wall to the bottom wall. The present device is to be used in connection with a cap and core having a key-way. In one embodiment, a key is pivotally attached to the receiving member. In this embodiment, the key is then flipped down to engage the key-way of the core. The receiving member receives the core and the cap. A blade extends through the receiving member proximate to the front opening. The blade extends into and through a portion of the cap close to the fiber core. In the manual machine, the cut cap is then rotated until the key-way is facing upwardly. The blade is then used to poke the cap to ease removal. In a second embodiment, a pin extends toward the blade. The pin pokes the cap and the blade cuts the cap. The core is engaged by cap grippers on the top wall and the bottom wall of the receiving member. A hook then engages the key-way. A force is applied to the hook and therefore to the key-way to force the cap away from the core. The cap can then be directed through a chute into a cap container. The core is then recycled.

15 Claims, 8 Drawing Sheets

FIBER CORE CAP REMOVER

BACKGROUND OF THE INVENTION

The present invention relates generally to the removal of metal caps from fiber cores used to transport rolled paper and the like, and more particularly to a device which cuts a fiber core having a core cap, the cut being made proximate to the core cap and then removes the core cap from the fiber core for recycling of the core as well as the cap.

It will be appreciated by those skilled in the art that many materials come wrapped around a fiber core. When these fiber cores bear certain materials such as carpeting, paper, and the like, the fiber core can be very heavy. Therefore, transport and movement of the loaded cores occurs by engaging the holes at the ends of the core. Unfortunately, the art soon discovered that the fiber core, although suitably designed for bearing the material, often failed during movement of the material. Therefore, fiber core caps were developed such as those disclosed in U.S. Pat. Nos. 4,460,087; 4,995,512; and 3,942,638. The art developed several ways of placing a cap into a core such as that disclosed in U.S. Pat. No. 4,195,399. However, it was soon discovered that these fiber cores needed to be recycled. Unfortunately, as with any kind of recycling, materials of different types should not be recycled to the same place. Therefore, attempts have been made to separate the metal fiber core cap from the fiber core so that they could be recycled separately.

U.S. Pat. No. 3,763,619, issued to Stone, discloses a cap which is specifically removable with a screwdriver. Unfortunately, this type of cap will not work with core caps for three inch (3") diameter rolls. These core caps come in wall thicknesses of ⅜", ½", and ⅝". For example, the ⅝" thickness core cap is called a 0.660 or 660 wall core cap. The ⅜" or ½" core cap is called a light duty core cap. Obviously, the heavier the wall thickness, the more durable the cap. These core caps have an outside ridge typically in the range of ¼" to 1¾" and can penetrate the core anywhere from between one-and-one-quarter (1¼") to three (3") inches. Also, a metal point can be provided in the core cap which specifically engages the core thereby making it more difficult for the cap to be separated from the core. Therefore, although Stone may work with light duty caps, it would be ineffectual in an application for removal of a three inch (3") diameter core cap.

What is needed, then, is a device which can remove a cap from a core. This needed cap remover must be capable of removing heavy duty three inch (3") caps as well as lighter 3 inch caps. This cap remover must be quick and efficient. This cap remover is presently lacking in the prior art.

SUMMARY OF THE INVENTION

The present invention discloses a device for removing a cap from a fiber core. The device has a housing which resides on a base. The housing includes a receiving member which is defined by a front opening, a rear opening distally located from the front opening, an top wall and an bottom wall joining the front opening and rear openings, a right wall and a left wall joining said front opening to said rear opening and joining said top wall to the bottom wall. The present device is to be used in connection with a cap and core having a key-way. In one embodiment, a key is pivotally attached to the receiving member. In this embodiment, the key is then flipped down to engage the key-way of the core. The receiving member receives the core and the cap. A blade extends through the receiving member proximate to the front opening. The blade extends into and through a portion of the cap close to the fiber core. In the manual machine, the cut cap is then rotated until the key-way is facing upwardly. The blade is then used to poke the cap to ease removal. In a second embodiment, a pin extends toward the blade. The pin pokes the cap and the blade cuts the cap. The core is engaged by cap grippers on the top wall and the bottom wall of the receiving member. A hook then engages the key-way. A force is applied to the hook and therefore to the key-way to force the cap away from the core. The cap can then be directed through a chute into a cap container. The core is then recycled.

Accordingly, one object of the present invention is to provide a device capable of removing a fiber core cap from the fiber core.

Still another object of the present invention is to provide a device which engages the key-way of a fiber core cap.

Still another object of the present invention is to provide a device which is usable in connection with three inch (3") diameter cores.

Still another object of the present invention is to provide a machine which provides flexibility to separate the three main types of three inch (3") diameter core caps from the core.

DESCRIPTION OF THE PREFERRED EMBODIMENTS

Figure 1A:
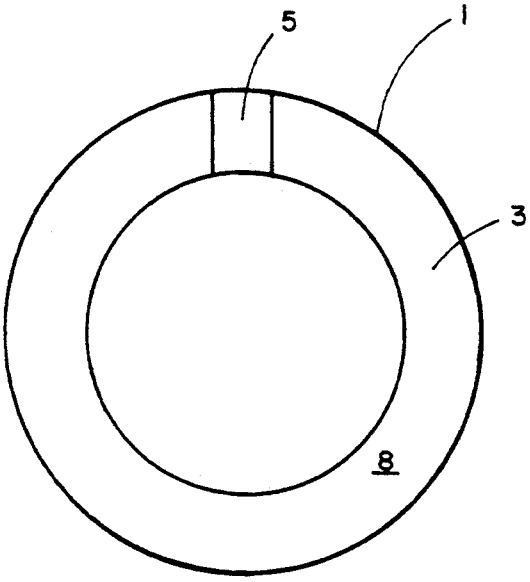
FIG. 1*a* is an end view of a typical core cap of the prior art.
Figure 1B:
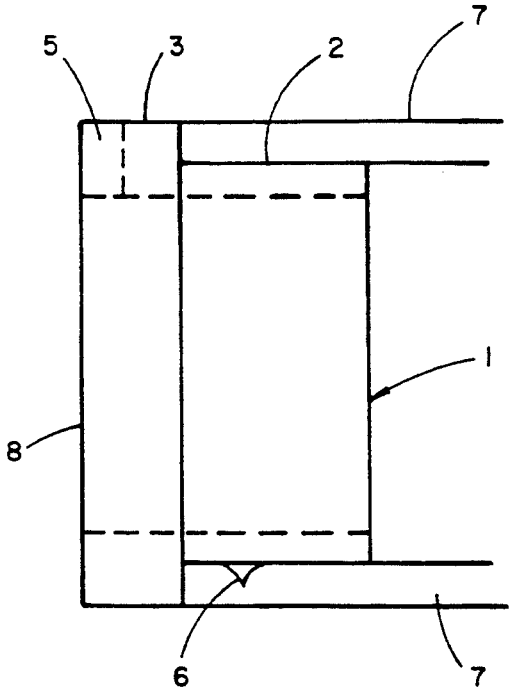
FIG. 1*b* is a side view of the core cap of the prior art, shown partially in phantom as inserted into the hollow center of a fiber core.

Referring now to FIGS. 1*a* and 1*b* there is shown generally at 1 a typical metal core cap found in the prior art which is presently used in standard three inch (3") diameter fiber cores. Core cap 1 has penetrating member 2 and rim 3. Penetrating member 2 comprises wall 4 which extends radially to form penetrating member 2.

Similarly, rim 3 extends radially around cap 1. Cap 1 has key-way 5 and in many embodiments found in the prior art will also have point 6. Point 6 is a sharp metal piece which extends 90 degrees away from wall 4 to engage core 7. Cap 1 for three inch (3") diameter cores comes in three major types in the prior art, depending upon the thickness of wall 4. ⅜" or ½" wall thickness caps are known as light duty caps. ⅝" wall thickness caps are known as heavy duty caps. The most heavy duty type of ⅝" wall thickness caps are known as super-k caps. A ⅜" wall thickness cap has a rim from face 7 to penetrating member 2 of substantially 1½" to 1¾". Similarly, the penetrating member 2 on a ⅜" wall thickness cap is substantially three inch (3"). For a ⅝" cap or a 660 cap or a 0.660 wall cap, the distance from face 8 to penetrating member 2 is substantially ¾" whereas penetrating member 2 is substantially one-and-one-quarter inch (1¼").

Figure 2:
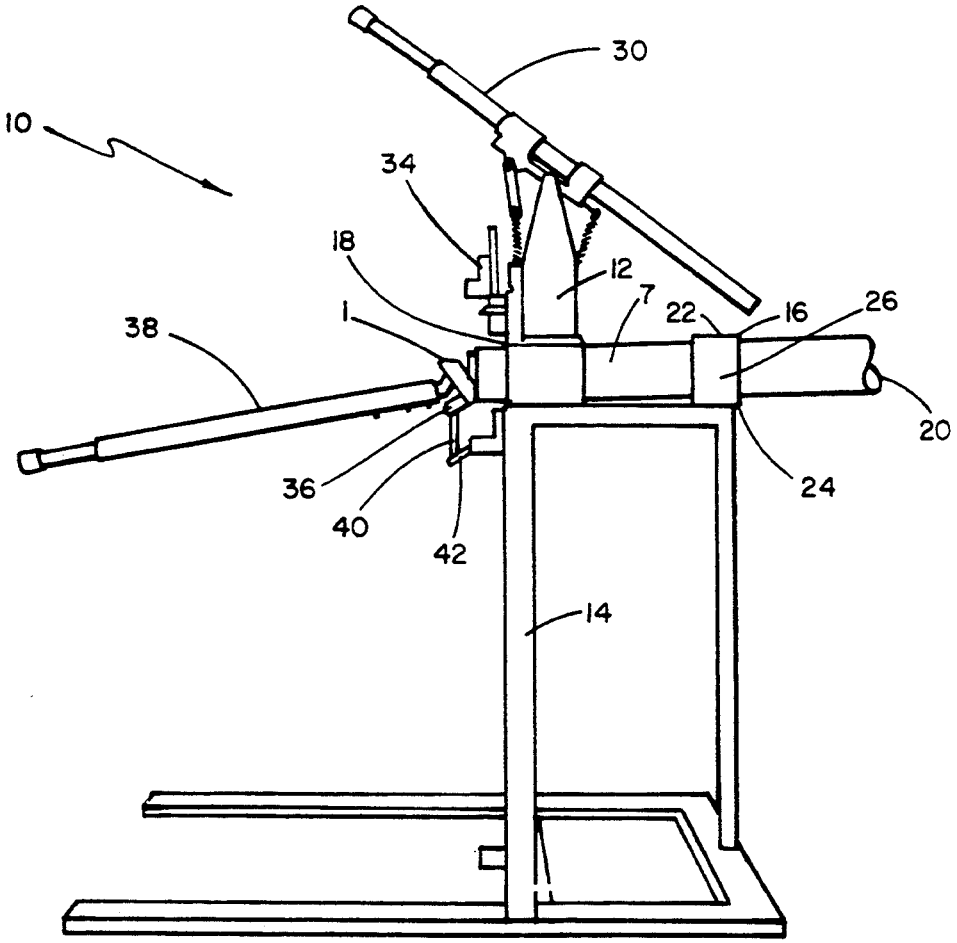
FIG. 2 is a perspective view of the manual core cap remover of the present invention.

Referring now to FIG. 2, there is shown generally at 10 a manual embodiment of the fiber core cap remover of the present invention. Core 7 having cap 1 is placed into device 10. Device 10 includes housing 12 which is supported by base 14. Device 10 has receiving member 16 which is includes front opening 18, rear opening 20, top wall 22, bottom wall 24, right wall 26, and left wall (28 in FIG. 5). Core 7 with cap 1 is inserted into receiving member 16, from rear opening 20 or from front opening 18, until cap 1 is proximate to front opening 18. Cutting force member 30 which is, in this embodiment, a lever, is manually pulled down thereby forcing blade (32 in FIG. 3) into core 7 proximate to cap 1. Core 7 is then manually rotated 180° and cutting force member 30 is again moved down, thereby forcing blade (32 in FIG. 3) into core 7 proximate to cap 1. In the preferred embodiment, core 7 is moved from back opening 20 toward front opening 18 approximately and substantially ¾ inches core 7 is rotated to allow cutting force member 30 to poke cap 1. To stabilize core 7 and cap 1, key 34 is provided to engage key-way (5 in FIGS. 1*a* and 1*b*) to prevent rotation of core 7. Therefore, during operation of the embodiment shown in FIG. 2, key-way (5 in FIGS. 1*a* and 1*b*) is faced downwardly for the first cut and upwardly for the second cut so that key 34 may easily engage key-way (5 in FIGS. 1*a* and 1*b*). After a cut and a poke have been made by blade (32 in FIG. 3), hook 36 is manipulated to engage key-way (5 in FIGS. 1*a* and 1*b*) of cap 1. A downward force is applied to lever 38 which causes hook 36 to rotate and separate cap 1 from core 7. Hook 36 attaches to housing 12 at pivot 40. Tension member 42 is used to provide proper tension on hook 36 in relation to cap 1. Both cutting force member 30 and lever 38 telescope so that greater leverage can be obtained when needed.

Figure 3:
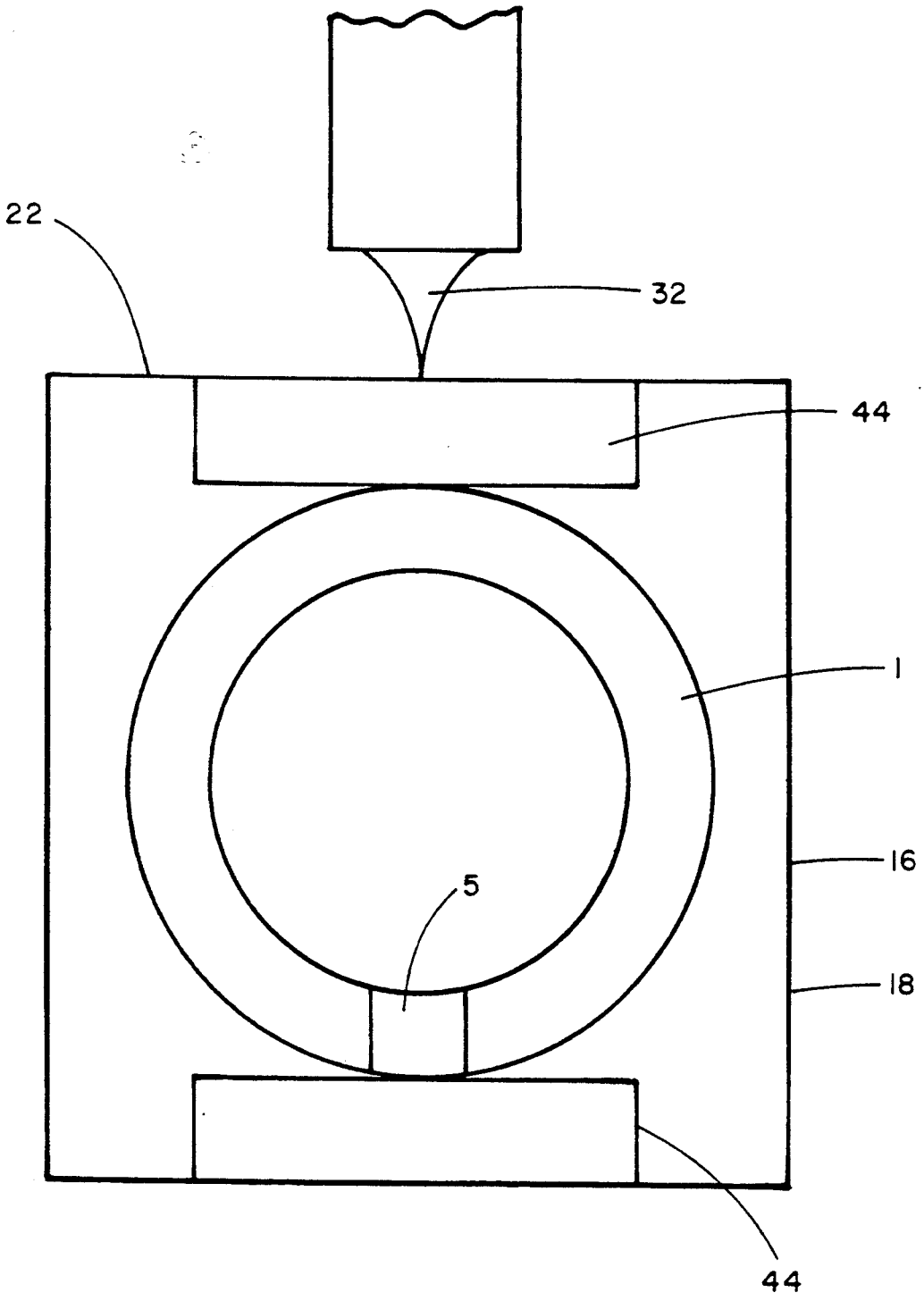
FIG. 3 is a view of the front opening of the receiving member showing the relationship between the blade and the core and core cap.

Referring now to FIG. 3 there is shown generally at 16 the receiving member of the present invention. For the purposes of all embodiments, front opening 18 will be the opening proximate to hook. Core (7 in FIGS. 1 and 2) is inserted into receiving member 16 (from the rear opening, not shown) such that cap 1 rests proximate to front opening 18. Core grippers 44 stabilize core 7. Receiving member 16 has an aperture (not shown) through top wall 22 through which blade 32 advances into core (7 in FIGS. 1 and 2) proximate to core cap 1. As stated earlier, after blade 32 makes its initial cut, core (7 in FIGS. 1 and 2) and cap 1 are rotated substantially 180° such that key-way 5 faces upwardly as opposed to downwardly so that blade 32 can make an additional cut.

Figure 4:
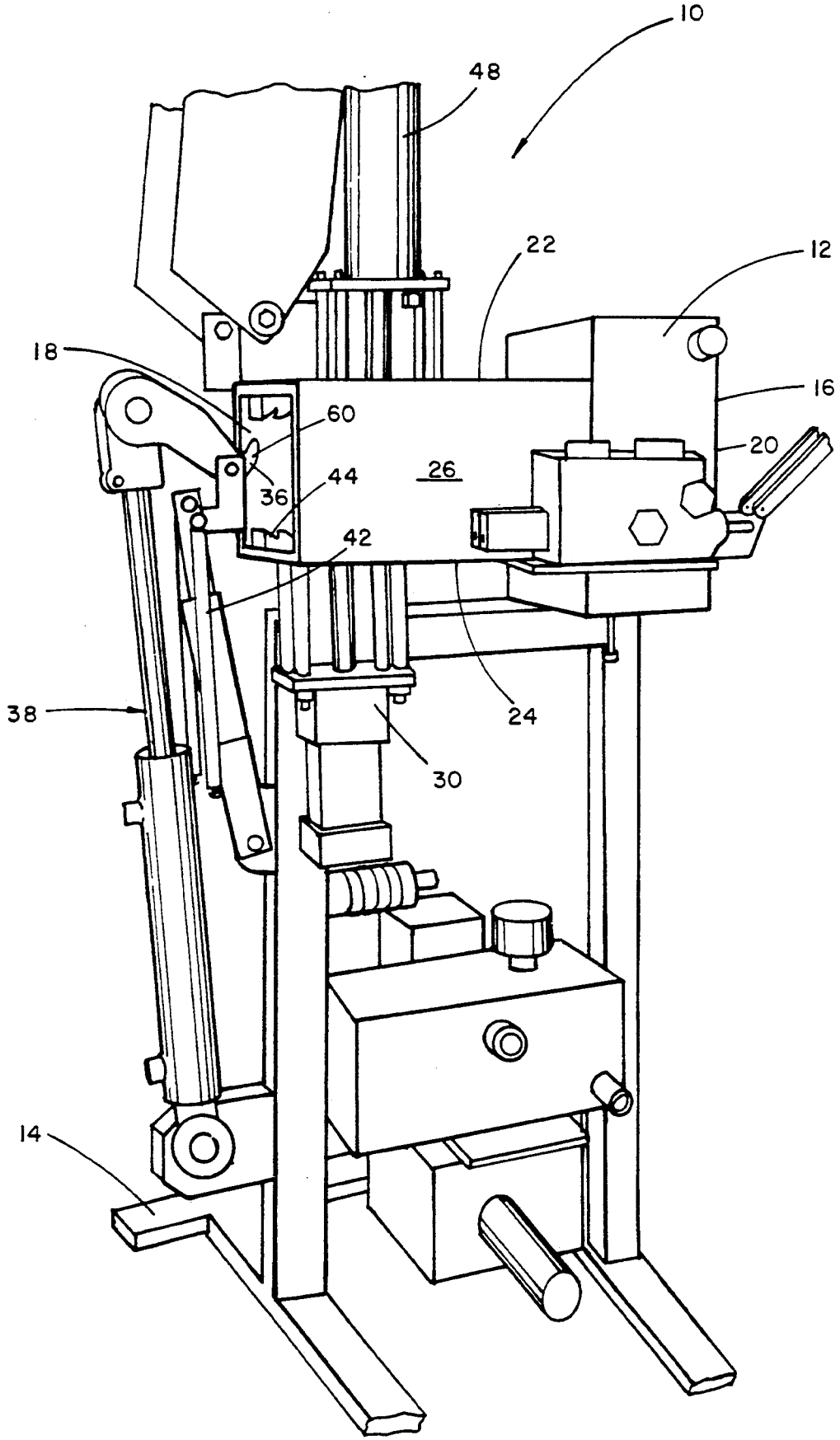
FIG. 4 is a right wall perspective view of the hydraulic core cap remover of the present invention.
Figure 5:
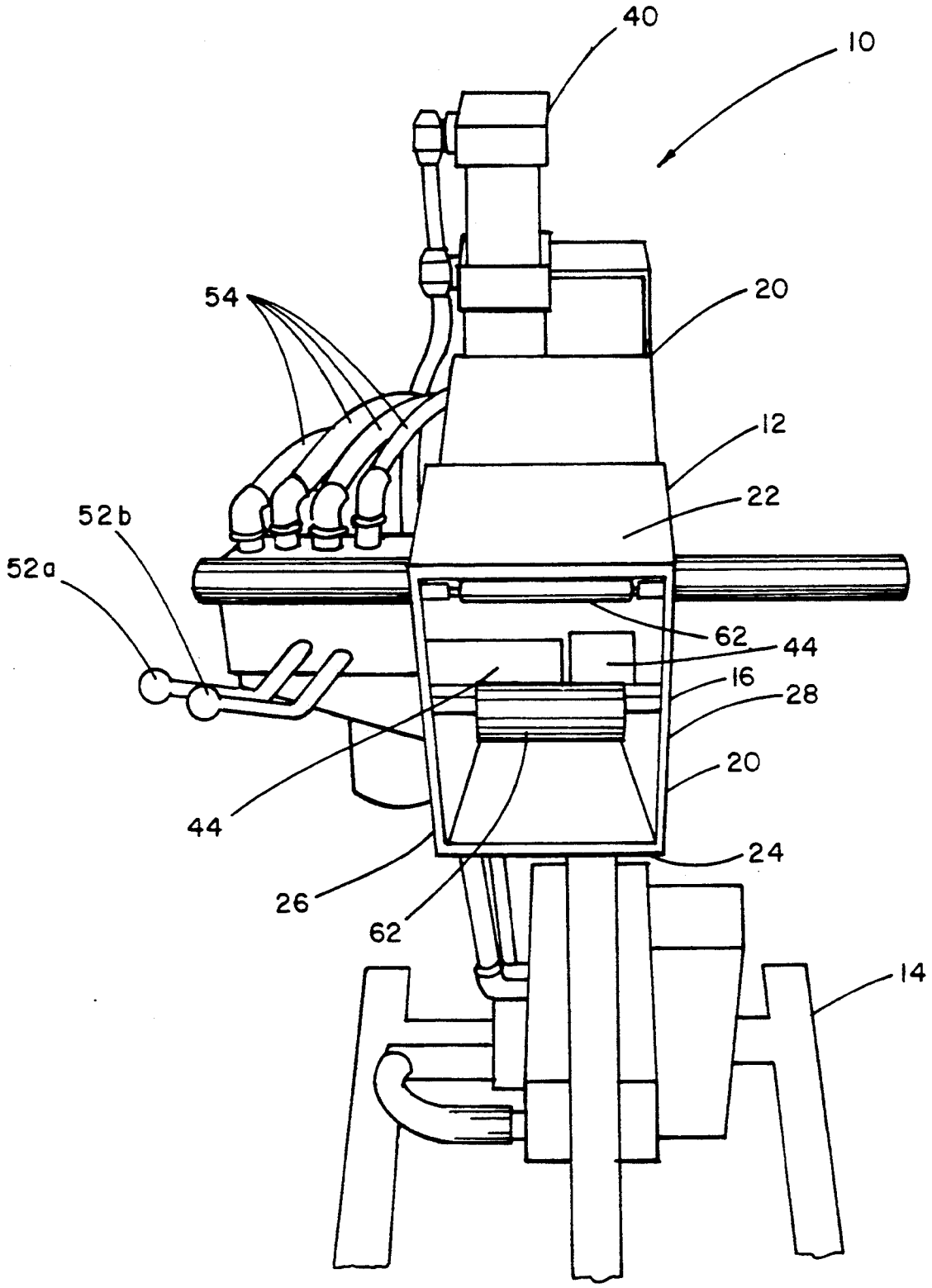
FIG. 5 is a rear perspective view of the hydraulic core cap remover of the present invention.
Figure 6:
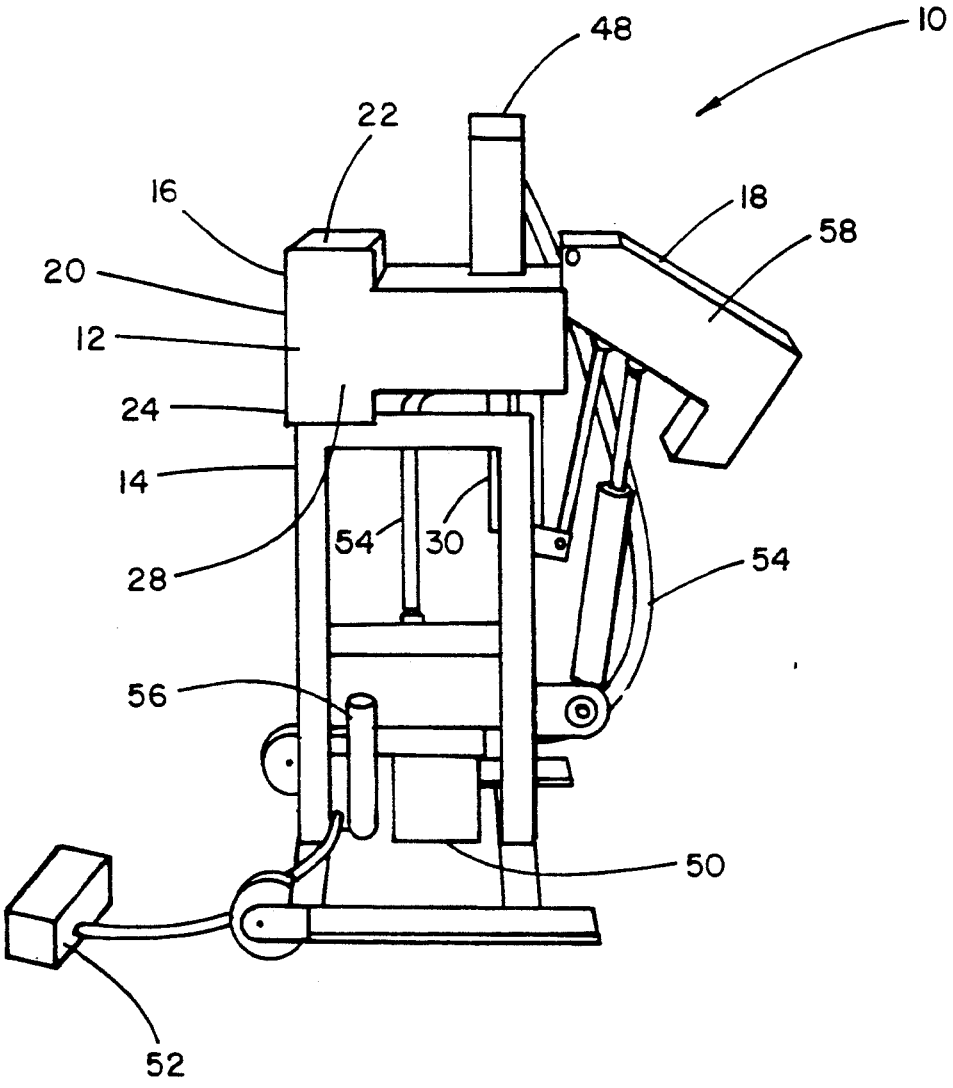
FIG. 6 is a left wall perspective view of the hydraulic core cap remover of the present invention.

Referring now to FIGS. 4, 5, and 6, there is shown generally at 10 the hydraulically operated embodiment of fiber cap core remover of the present invention. Fiber core cap remover 10 has housing 12 resting on base 14. Device 10 has receiving member 16 attached to housing 12. Receiving member 16 receives fiber core (7 in FIGS. 1 and 2) and cap (1 in FIGS. 1–3). Receiving member 16 includes front opening 18, rear opening 20, top wall 22, bottom wall 24, right wall 26, and left wall 28. In this embodiment, cutting force member 30 is an hydraulic piston which forces blade 32 upwardly. Similarly, pin force member 46 is also an hydraulic cylinder which forces pin (48 in FIG. 7) downwardly. Hydraulic pump 50 supplies fluid to the hydraulic cylinders in a conventional manner. Conventional hydraulic controls 52*a* and *b* regulate the flow of hydraulic fluid and pressure delivered to the hydraulic cylinders and therefore control their movement. Hydraulic hoses 54 conventionally transmit fluid from pump 50 to controls 52 and to the cylinders. Hydraulic fluid is stored in hydraulic reservoir 56. Proximate to front opening 18 of receiving member 16 is pivotally attached chute 58. After cap (1 in FIGS. 1–3) is removed, cap (1 in FIGS. 1–3) slides down chute 50 into a storage container (not shown).

Still referring to FIGS. 4, 5, and 6, after the cut is made with blade (32 in FIG. 7) and poke is made with pin (48 in FIG. 7), core is moved to left side of front opening 18 and hook 36 engages key-way (5 in FIGS. 1–3) of core cap (1 in FIGS. 1–3). Hook force member 38, which in this embodiment is an hydraulic cylinder, pivots hook 36 about point 60 thereby causing cap (1 in FIGS. 1–3) to separate from core (7 in FIGS. 1–3). Tension member 42 provides tension on hook 36 to provide the proper angle of separation.

Two rollers 62 are attached internally to right wall 26 and left wall 28 of receiving member 16, with one proximate to top wall 22, and a second proximate to bottom wall 24, and both proximate to rear opening 20, to help move core (7 in FIGS. 1–3) through receiving member 16 and to keep fingers of users out of harms way when machine is in operation. Rollers 62 are biased away from top wall 22 and bottom wall 24 by springs which cannot be seen in the figures. Core grippers 44 are attached to top wall 22 and bottom wall 24 to stabilize core (7 in FIGS. 1–3) and receiving member 16.

In the preferred embodiment, chute 58 can be raised. When chute 58 is raised, a solenoid switch is used to turn the entire mechanism and hydraulics off.

Figure 7:
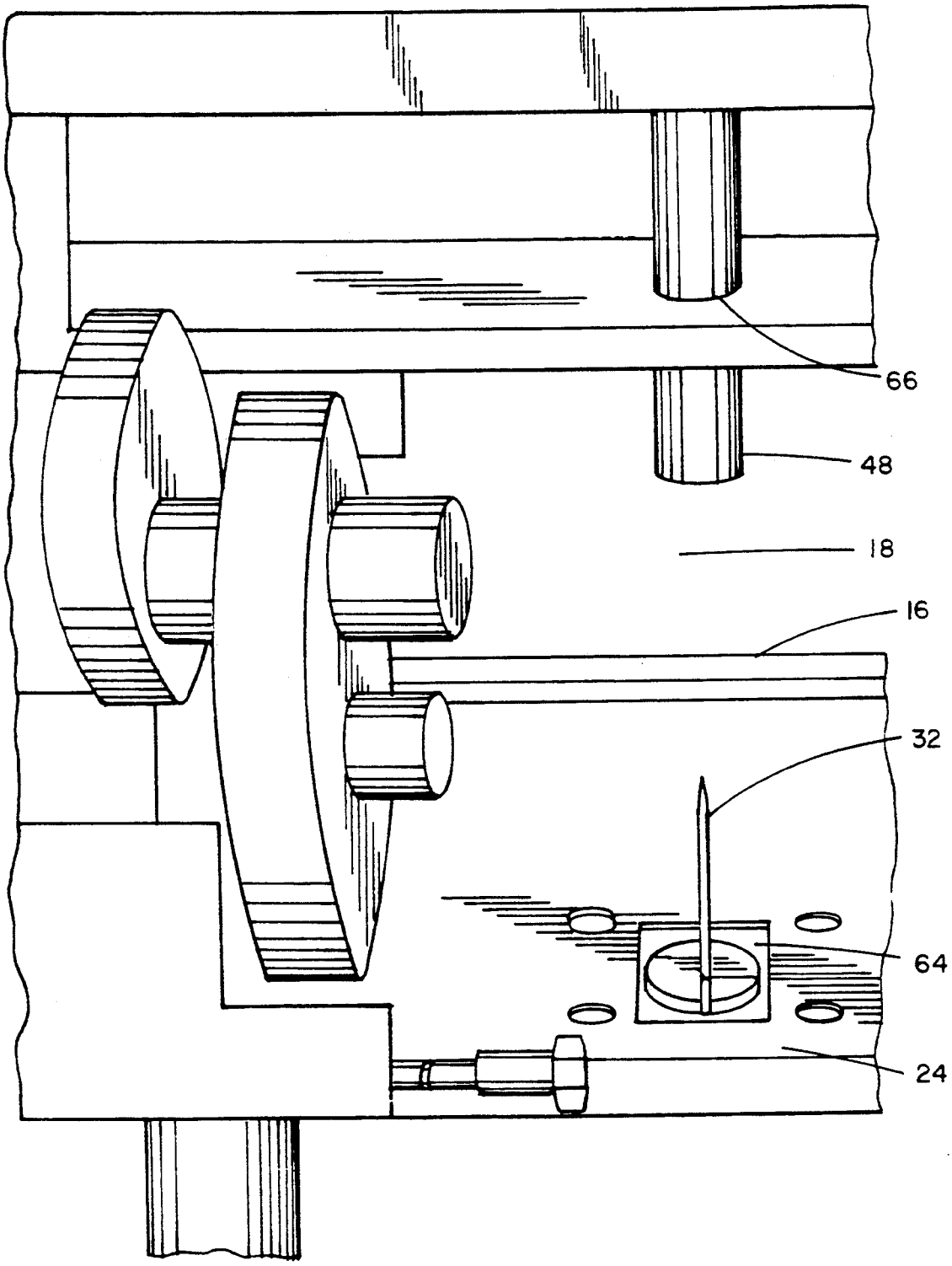
FIG. 7 is an enlarged front opening end view of the receiving member showing the relationship of the blade to the pin.

Referring now to FIG. 7, there is shown generally at 16 the receiving member of the present invention, as seen at front opening 18. Blade 32 extends upwardly through opening 64 of bottom wall 24 of receiving member 16, whereas pin 48 extends downwardly through hole 66 of top wall 22 of receiving member 16. Pin 48 and blade 32 are aligned offset such that a fully extended pin 48 and a fully extended blade 32 will not contact one another. Instead, blade 32 will cut core proximate to cap and poke will occur away from cap approximately one inch.

Figure 8:
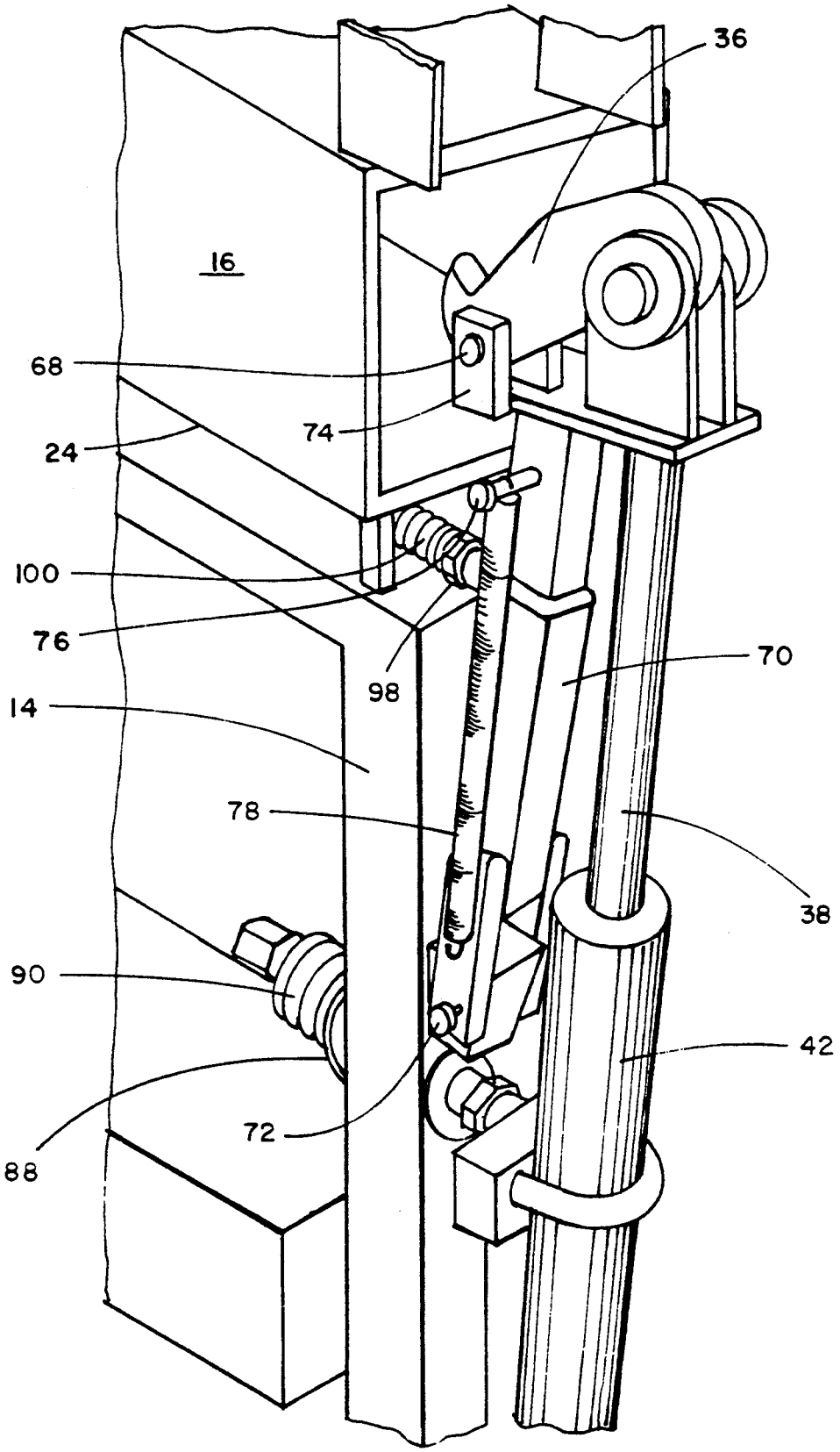
FIG. 8 is an enlarged perspective view of the tension member of the present invention.
Figure 9:
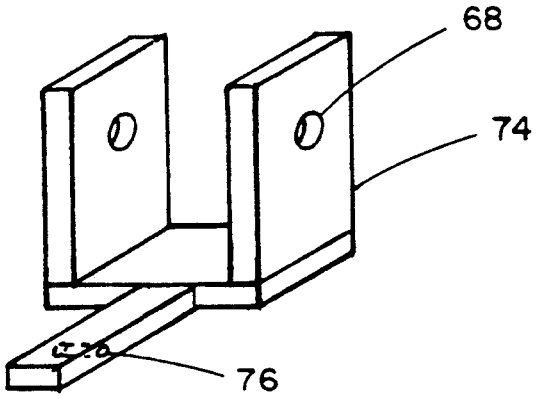
FIG. 9 is an enlarged view of the bracket which attaches the core cap hook.

Referring now to FIGS. 8 and 9 there is shown generally at 42 the tension member of the present invention and at 38 the hook force member of the present invention. Hook force member 38 is, in this embodiment, an hydraulic cylinder which is pivotally attached to hook 36. Hook force member 38 is secured to base 14 by bolt 88 passing through base 14 with a concentrically mounted coil spring 90 to pull force member 38 toward base 14. Hook 36 is, in turn, pivotally attached to bracket 74 at pivot point 68. Tension member 42 includes telescoping elongated member 70 having front opening 92 and rear opening 94. Elongated member 70 has first section 71*a* biased away from second section 71*b* through internal spring. Brace 96 attaches member 70 to base 14 proximate to rear opening 94 at point 72. Bracket 74 is pivotally attached to elongated telescoping member 70 at pivot point 76. Springs 78 ensure that tension is always provided to elongated member 70 at pivot point 76 and, in turn, pivot point 68. Elongated member 70 is also attached to base 14 proximate to receiving member 16 by bolt 98 and pulled toward base 14 by coil spring 100, mounted around bolt 98.

Figure 10:
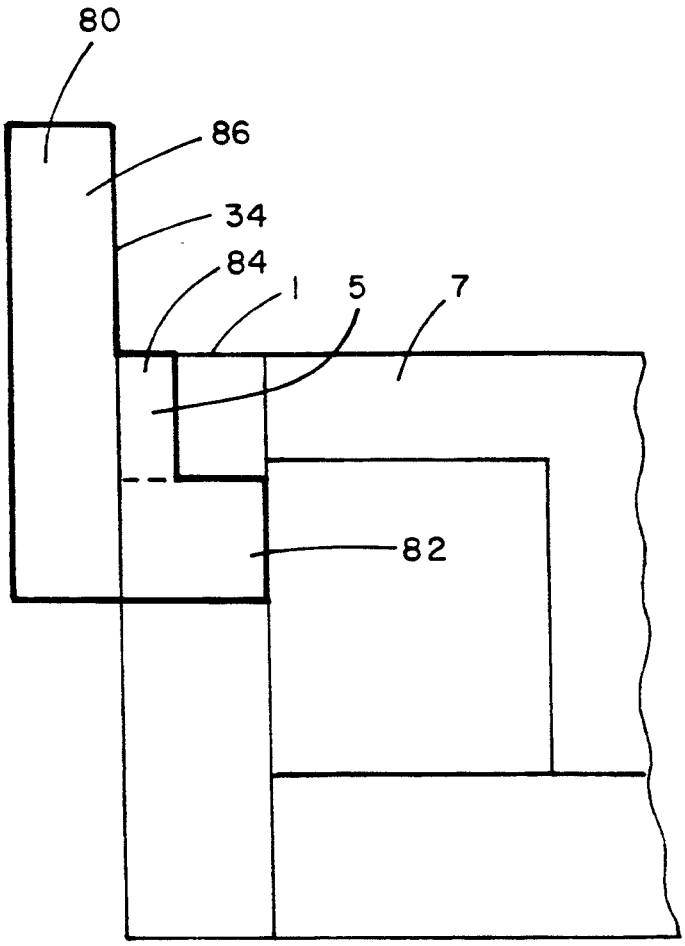
FIG. 10 is an enlarged side view of the key of the present invention engaged with the keyway of a core cap.

Referring now to FIG. 10 there is shown generally at 34 the key for the manual embodiment of the present invention as it engages key-way 5 of cap 1. Key 34 pivotally attaches to housing 12 at pivot point 80. Key 34 is substantially stair-stepped having first step 82, second step 84, and third step 86. First step 82 is the longest and extends into core cap 1. Second step 84 is an intermediate step which engages key-way 5. Third step 86 is vertically elongated. When key 34 engages key-way 5, core 7 can not easily be rotated.

Thus, although there have been described particular embodiments of the present invention of a new and useful fiber core cap remover, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A device for removing a cap from a fiber core comprising:

a. a housing;

b. means attached to said housing for receiving said core;

c. means attached to said housing for engaging said cap of said received core;

d. means for cutting and poking said core proximate to said engaged cap;

e. means attached to said housing for engaging said core while said core is in said core receiving means; and f. means for separating said cap from said engaged core.

2. The device of claim 1 further comprising means for directing said separated cap into a container attached to said housing.

3. The device of claim 2 wherein said means for directing said separated cap into a container comprises a chute attached to said housing.

4. The device of claim 1 wherein said means for receiving said core attached to said housing comprises a receiving member having a front opening, a rear opening distally located from said front opening, a top wall and a bottom wall joining said joint opening to said rear opening, a right wall and a left wall joining said front opening to said rear opening and joining said top wall to said bottom wall.

5. The device of claim 4 wherein said means for engaging said cap of said received core housing comprises a key pivotally attached to said receiving member for engaging a key-way on said core cap.

6. The device of claim 4 wherein said means for cutting and poking said core proximate to said engaged cap comprises a blade extending through said receiving member proximate to said front opening.

7. The device of claim 6 wherein said means for cutting and poking said core proximate to said engaged cap further comprises:

a. said blade extensible through said bottom wall of said receiving member; and b. a pin extensible through said top wall of said receiving member proximate to said front opening.

8. The device of claim 5 wherein said means for engaging said core attached to said housing comprises:

a. a first cap gripper attached to said top wall proximate to said front opening; and b. a second cap gripper attached to said bottom wall proximate to said front opening.

9. The device of claim 4 wherein said means for separating said cap from said engaged core comprises:

a. a hook adapted for engaging said key-way; and b. means for rotating said hook such that said cap is pulled away from said core.

10. The device of claim 9 wherein said means for rotating said hook comprises:

a. a lever pivotally attached to said housing; and b. means joining said hook to said lever such that applying a force to said lever rotates said hook.

11. The device of claim 9 wherein said means for rotating said hook comprises a hydraulic cylinder pivotally attached to said hook such that said hydraulic cylinder rotates said hook.

12. A device for removing a cap from a fiber core comprising:

a. a housing;

b. a receiving member attached to said housing for receiving said core, said receiving member having a front opening, a rear opening distally located from said front opening, a top wall and a bottom wall joining said front opening to said rear opening, a right wall and a left wall joining said front opening to said rear opening and joining said top wall to said bottom wall;

c. means attached to said housing for engaging said cap of said received core;

d. a blade extensible through said bottom wall of said receiving member proximate to said front opening for cutting said core proximate to said engaged cap;

e. a pin extensible through said top wall of said receiving member proximate to said front opening;

f. means attached to said housing for engaging said core while said core is in said core receiving means;

g. a hook for separating said cap from said engaged core, said hook adapted for engaging said key-way;

h. means for rotating said hook such that said cap is pulled away from said core; and i. a chute attached to said housing for directing said separated cap into a container.

13. A device for removing a cap from a fiber core comprising:

a. a housing;

b. a receiving member attached to said housing for receiving said core, said receiving member having a front opening, a rear opening distally located from said front opening, a top wall and a bottom wall joining said front opening to said rear opening, a right wall and a left wall joining said front opening to said rear opening and joining said top wall to said bottom wall;

c. a key attached to said housing for engaging said cap of said received core at a key-way on said core cap;

d. a blade for cutting and poking said core proximate to said engaged cap, said blade extending through said receiving member proximate to said front opening;

e. a first cap gripper and a second cap gripper attached to said housing for engaging said core while said core is in said core receiving means, said first cap gripper attached to said top wall proximate to said front opening, said second cap gripper attached to said bottom wall proximate to said front opening;

f. a hook for separating said cap from said engaged core, said hook adapted for engaging said key-way; and g. means for rotating said hook such that said cap is pulled away from said core.

14. The device of claim 13 wherein said means for rotating said hook comprises:

a. a lever pivotally attached to said housing; and b. means joining said hook to said lever such that applying a force to said lever rotates said hook.

15. The device of claim 13 wherein said means for rotating said hook comprises a hydraulic cylinder pivotally attached to said hook such that said hydraulic cylinder rotates said hook.

* * * * *